United States Patent [19]

Coneglio

[11] Patent Number: 4,564,091

[45] Date of Patent: Jan. 14, 1986

[54] WRITING BOARD

[76] Inventor: August F. Coneglio, 8083 Rollingbrook Rd., Sagamore Hills, Ohio 44067

[21] Appl. No.: 504,815

[22] Filed: Jun. 16, 1983

[51] Int. Cl.[4] ..... A45C 3/02

[52] U.S. Cl. ..... 190/11; 108/33; 108/102; 108/143; 150/52 B; 190/900; 248/461; 428/12

[58] Field of Search ..... 190/11, 12 R, 12 A, 190/104, 109, 110, 900, 901, 902; 248/461; 108/33, 34, 38, 90, 102, 143; 312/231, 244; 428/8, 12; 150/52 B

[56] References Cited

U.S. PATENT DOCUMENTS

| | | | |
|---|---|---|---|
| 33,529 | 10/1861 | Lane | 108/34 X |
| 398,669 | 2/1889 | Starkey | 150/52 C |
| 489,518 | 1/1893 | Ambruster | 248/461 X |
| 831,797 | 9/1906 | Miller | 108/93 |
| 2,609,072 | 9/1952 | Levinson | 190/11 |
| 3,082,049 | 3/1963 | Lifton | 190/11 X |
| 3,112,017 | 11/1963 | Lifton | 190/11 |
| 3,483,954 | 12/1969 | Michalski | 108/33 X |
| 4,095,533 | 6/1978 | Leveille | 108/90 |

*Primary Examiner*—Henry F. Epstein

*Attorney, Agent, or Firm*—Renner, Otto, Boisselle & Lyon

[57] ABSTRACT

A writing board for use as an accessory to a brief or attache case has a main housing and four telescopically received auxiliary panels. The auxiliary panels may be telescoped outward to form together with the main housing a large surface on which to rest papers and files or telescoped into the housing in overlapping relationship to form a compact unit readily stored within a brief or attache case. The housing is formed of three parallel plates spaced apart to form two passages in each of which a pair of auxiliary panels is received. Strips of panel material, metal channels or special clips may be used to hold the plates of the housing in proper spaced relation. The two lateral auxiliary panels include pockets to secure papers and the edges of one auxiliary panel and the housing include lips to limit slippage of papers or writing tools into a seated user's lap.

20 Claims, 11 Drawing Figures

Fig. 8
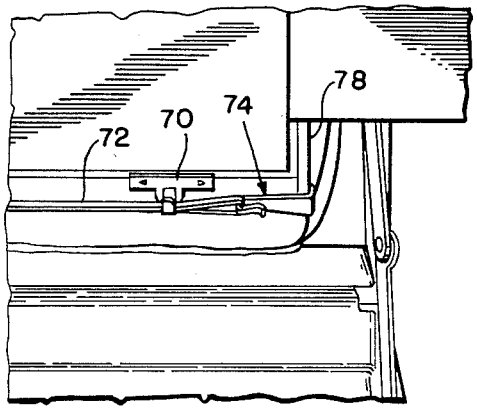
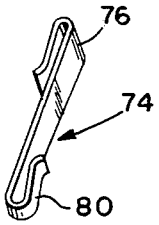
Fig. 9
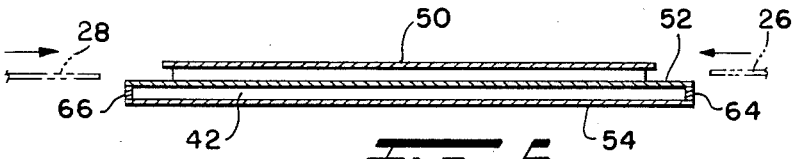
Fig. 5
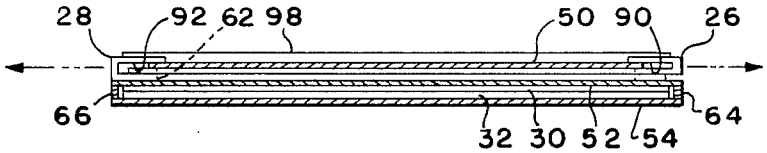
Fig. 7
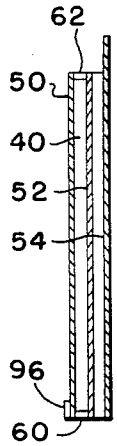
Fig. 6
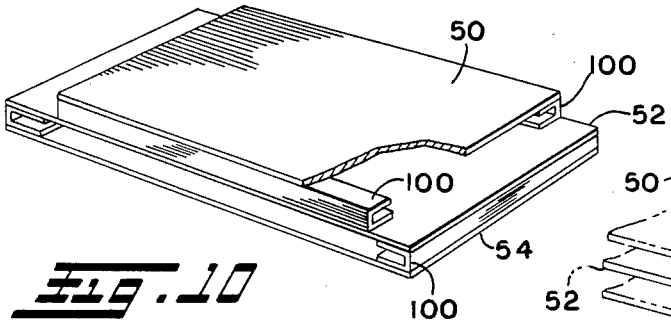
Fig. 10
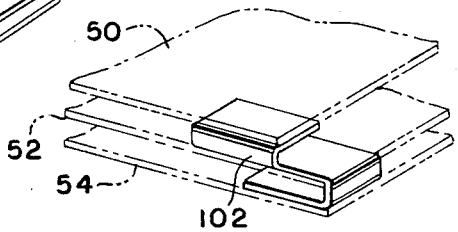
Fig. 11

WRITING BOARD

BACKGROUND OF THE INVENTION

The present invention relates to a writing board which may be used together with a briefcase as an accessory thereto. In particular, the present invention relates to an expandable writing board which, when closed, fits compactly within a briefcase and, when opened, provides a large surface for writing or supporting open files and papers for reading or writing.

People who carry papers and/or files such as business files or other documents in a briefcase or attache case frequently need a surface larger than the largest face of their case on which to open and examine such files or documents. This need is especially acute on trains, airplanes, or other public transit. For most purposes the required surface need not be entirely flat, so long as it provides the needed support to the papers and documents and includes a flat area where writing may be done. In cramped quarters it is important that means be provided for retaining loose papers and for preventing papers from sliding down a surface inclined toward a seated user's lap. Moreover, it is also desirable that a writing surface be readily portable. This requires that it fold or collapse to a size that will conveniently fit within a standard brief or attache case.

SUMMARY OF THE INVENTION

The present invention meets requirements not met by any known prior art device. The present invention provides an expandable accessory writing board for a brief or attache case which readily stores compactly within the case when folded up. When opened, the writing board expands to provide support for papers and documents, and it has retaining pockets at each lateral edge and along the top to secure loose papers as well as a ridge at the edge closest to the lap of the user. The writing board of the present invention comprises a housing assembly with a top planar surface, and four planar auxiliary panels which telescope into pockets within the housing assembly to allow the writing board to fit within an attache case. The auxiliary panels expand telescopically outward when the writing board is in use to provide a large support surface.

When in use, the writing board is connected with a briefcase and when required, the case is placed on a user's lap and the hinged top is opened. The four auxiliary panels may then be extended. One panel telescopes away from the user and one toward the user's lap. The other two auxiliary panels telescope laterally, one to the user's right and one to the left. Along the outside edges of the two laterally telescoping auxiliary panels there are pockets which receive and hold at least an edge portion of papers and documents. The lowermost edges of the main housing assembly's planar surface and the auxiliary panel which extends toward the user's lap are both provided with ridges which prevent papers from sliding into the user's lap.

The writing board of the present invention is designed for compact closing. The housing assembly is formed of three rectangular plates which are slightly spaced apart and parallel to each other to define two passages, into each of which a pair of the auxiliary panels may be telescopically received. Of the three rectangular plates forming the housing assembly, the top and middle plates are joined along their front and rear edges, i.e., the edges closest to and farthest from the lap of a seated user. These two plates are spaced apart by a distance only slightly larger than twice the thickness of the auxiliary panels. The two laterally extending auxiliary panels are telescoped from opposite directions into and out of the space between the top and middle plates of the housing assembly. The middle and bottom plates of the housing assembly are joined along lateral edges, i.e., the edges of the plates to the user's right and left, and the front and rear auxiliary panels telescope between them from opposite directions.

Different methods may be used to secure the three plates of the housing assembly to each other and different materials may be used to make these plates. Adhesive and narrow strips of plate material may be used where the material is cardboard, metal, or plastic. In addition, with plates made of any of these materials spacing apart of the plates of the housing assembly may be accomplished by the use of U-shaped metal channels or specially shaped clips which are mounted at each corner of the three housing plates.

The invention, then, comprises the features hereinafter fully described and particularly pointed out in the claims, the following description and annexed drawings setting forth in detail certain illustrative embodiments of the invention which are indicative, however, of but a few of the various ways in which the principles of the invention may be carried out.

BRIEF DESCRIPTION OF THE DRAWINGS

In the annexed drawings:

FIG. 5 is a view taken along line 5—5 of FIG. 3;

FIG. 6 is a view taken along line 6—6 of FIG. 3;

FIG. 7 is a view looking in the direction of arrows 7—7 of FIG. 2;

FIG. 8 illustrates a means for securing the writing board of FIG. 1 to the case of FIG. 1;

FIG. 9 illustrates a component of the apparatus of FIG. 8;

FIG. 10 illustrates a second embodiment of a housing assembly for use in the present invention; and FIG. 11 illustrates a portion of yet another housing assembly for use in the present invention.

DESCRIPTION OF PREFERRED EMBODIMENTS

Figure 1:
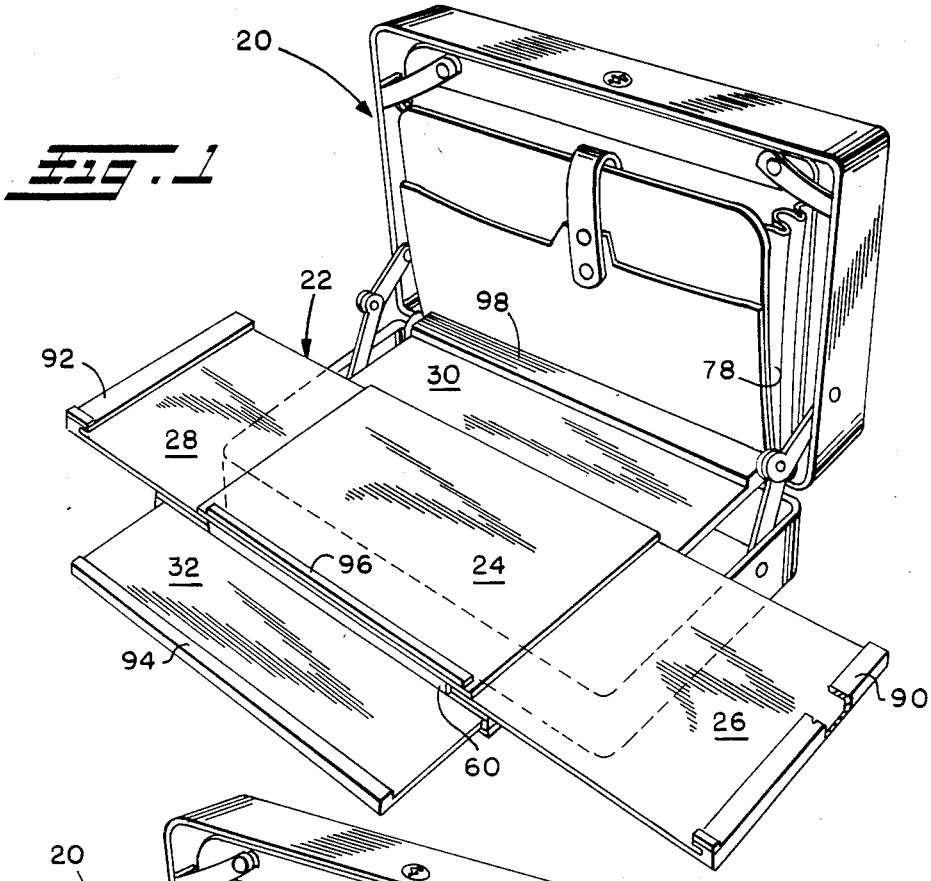
FIG. 1 illustrates an attache case equipped with an expandable accessory writing board constructed in accordance with the present invention and shown in an expanded condition.

FIG. 1 illustrates a brief or attache case 20 provided as an accessory thereto with a writing board 22 constructed in accordance with the present invention. The writing board 22 includes a housing assembly 24 which telescopically receives two laterally movable auxiliary panels 26 and 28. In addition, the housing assembly 24 telescopically receives a front auxiliary panel 30 and a rear auxiliary panel 32. The auxiliary panels 26–32 may be moved from the open or extended position shown in FIG. 1 to the closed position illustrated in FIG. 2. In the closed position, the entire writing board 22 fits easily within the case 20, whose top may then be closed in a conventional manner. When opened with the panels in the positions shown in FIG. 1, the writing board 22 may be used for supporting files and as a work surface in otherwise cramped quarters such as airplane, train, or bus seats, especially when the attache case is placed in the user's lap with the rear panel 32 closest to the lap of the user.

Figures 3, 4:
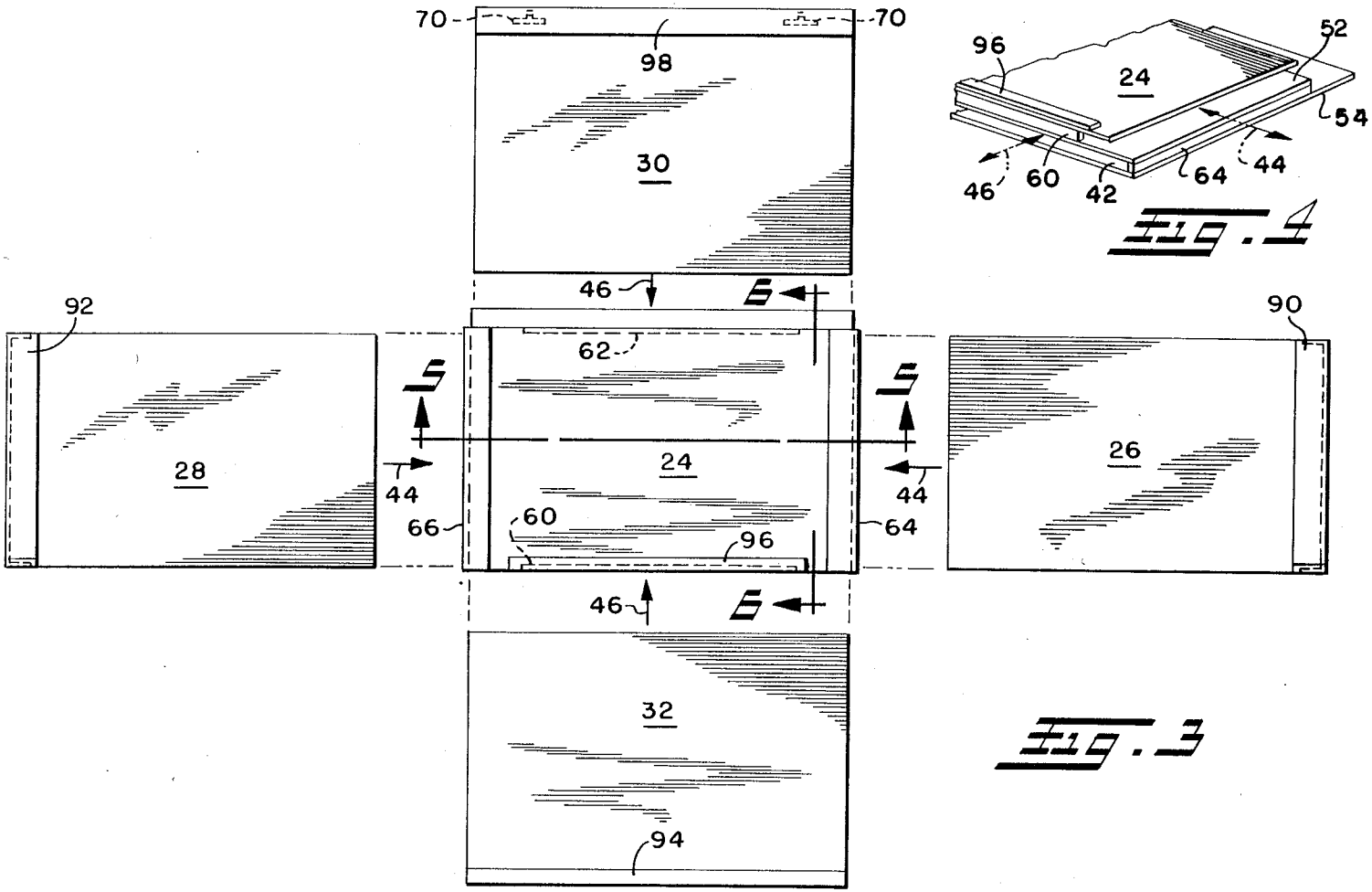
FIG. 3 illustrates a plan view of the components of the writing board of FIG. 1.
FIG. 4 illustrates a housing assembly forming a part of the writing board of FIG. 1.

The housing assembly 24 is formed with two parallel passages 40 and 42 (FIG. 4) which receive the auxiliary panels 26–32. The upper passage 40 receives the lateral auxiliary panels 26 and 28 for movement in the direction of arrows 44 which extend generally to the user's right and left when the writing board 22 is in use. The passage 42 receives the front and rear auxiliary panels 30 and 32 for movement in the direction of arrows 46 which is generally toward and away from the user of the writing board 22. In a plan view the arrows 44 and 46 are perpendicular to each other although, because they are vertically offset it is more precise to say that the planes normal to arrows 44 and 46 are perpendicular to each other.

The housing assembly 24 is formed of three generally planar plates 50, 52, and 54, which are parallel and spaced apart from each other. The passage 40 extends between the upper plate 50 and the middle plate 52 while the passage 42 is located between the middle plate 52 and the lower plate 54. Means are provided for holding the plates 50, 52, and 54 of the housing assembly in spaced relationship to one another to define the passages 40 and 42.

In one embodiment, the plates 50 and 52 are formed of cardboard and cardboard strips 60 and 62 which are adhered between the front and rear edge portions of the plates 50 and 52. Fourteen gauge cardboard has proven sufficiently stiff to provide the needed support yet light enough to provide a conveniently portable writing board. The plates 50–54 and panels 26–32 may also be made of a light metal or plastic.

The strips 60 and 62 (FIG. 6) hold the upper and middle plates 50 and 52 apart by a distance approximately equal the combined thickness of the lateral auxiliary panels 26 and 28. The strips 60 and 62 are parallel and spaced apart by a distance approximately equal to the width of the lateral auxiliary panels 26 and 28. Therefore, the strips 60 and 62 form sides to the passage 40 and secure the upper and middle plates 50 and 52 to each other so that the lateral auxiliary panels 26 and 28 may be telescopically received in the passage 40 in overlapping relationship.

Similar strips 64 and 66 (FIGS. 4, 5, and 7) are adhered between the lower plate 54 and the middle plate 52 to define the passage 42. The strips 64 and 66 are parallel to each other and adhered between opposite lateral edge portions of the middle and lower plates so that the rear auxiliary panel 32 and the front auxiliary panel 30 may be telescopically received in the passage 42 for movement in the direction of arrow 46.

The writing board 22 may be easily secured to the case 20 by means of clips 70 which are secured to the underside of the front auxiliary panel 30. As shown in FIG. 8, the clips 70 have a hook portion to engage a resilient elastic band 72 which extends parallel to the hinge line between the top and base of the case 20. The elastic band 72 may be connected with the case by means of hooks 74 shown in detail in FIG. 9. The hook 74 has a J-shaped end portion 76 adapted to engage a portion of the interior of the case 20. Specifically, the J-shaped portion 76 is intended to engage the file organizer 78 commonly secured to the inside top of the cases such as case 20. The hook 74 also includes a hook portion 80 opposed to the J-shaped end portion 76. The hook portion 80 is intended to engage the elastic band 72.

The two lateral panels 26 and 28 are provided with pockets 90 and 92 (FIGS. 3 and 7) along one edge thereof. The pockets are comprised of a portion of the respective panels which are folded over on themselves and provide a means for securing loose papers or other documents to prevent their loss. The pockets 90 and 92 are formed so that when the writing board 22 is in its closed position illustrated in FIG. 2 each fits snugly against the upper plate 50 (see FIG. 7). Since the lateral panels 26 and 28 are telescoped into passage 40 in overlapping manner, the pocket 92 is twice the depth of the pocket 90 so that the pocket 92 accommodates the thickness of the upper plate 50 as well as the thickness of the lateral panel 26 when the writing board is closed as in FIGS. 2 and 7. By contrast, the pocket 90 of panel 26 need only accommodate the thickness of the upper plate 50.

Lips 94 and 96 (FIGS. 1 and 2) are provided on the rear panel 32 and the rear edge portion of the upper plate 50 of the housing assembly 24. The lips 94 and 96 extend parallel to the long edges of the rectangular panel 32 and upper plate 50 and provide an edge against which papers or documents may rest. The lips 94 and 96 prevent pencil or other writing implements from rolling downward off the writing board 22. Additionally, the lip 94 limits the extent of telescopic movement of the auxiliary panel 32 into the passage 42.

Figure 2:
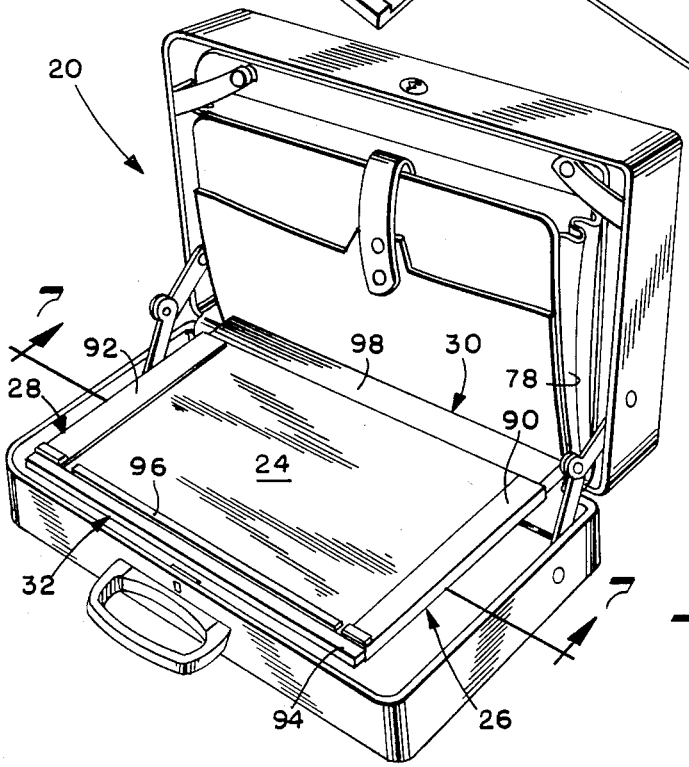
FIG. 2 illustrates the attache case and writing board of FIG. 1 with the writing board in a contracted condition.

The front auxiliary panel 30 is also provided with a headboard 98 which extends upward above the top surface of the pockets 90 and 92 by a small margin and provides a finished look to the closed writing board 22 as shown in FIG. 2. Additionally, the headboard 98 limits telescopic movement of the front auxiliary panel 30 into the passage 42, and also forms a pocket with the board 30 for securing papers, as do the pockets 90 and 92 with their respective boards.

FIGS. 10 and 11 show additional means for holding the plates 50, 52, and 54 in parallel spaced relation to each other. In FIG. 10 U-shaped channels 100 formed of metal replace the cardboard strips 60, 62, 64, and 66 (FIG. 3), but perform otherwise the same function. In FIG. 11 a metal bracket 102 is provided at each corner to secure the plates 50, 52, and 54 to each other. The bracket 102 is formed from a flat piece of metal originally having an L-shaped configuration both ends of which are bent back onto each other to the form shown in FIG. 11. Four such brackets are provided, one at each corner, and they replace the cardboard strips 60–66 or U-shaped channel 100 of FIGS. 3 and 10, respectively.

Thus it is clear that the present invention provides a writing board 22 which meets the requirements not met by known prior art devices. The writing board 22 is an expandable accessory suitable for use in attachment to a brief or attache case 20 (FIG. 1). The writing board 22 stores compactly within the case 20 as shown in FIG. 2, and when opened the writing board expands to provide support for papers and documents. Further, retaining pockets 90 and 92 are provided along lateral edges to secure loose papers and lips 94 and 96 across the bottom edge of the writing board 22 prevent papers and writing tools from rolling into the lap of the user.

The writing board 22 includes a housing assembly 24 with a planar top surface and four planar auxiliary panels 26–32 which telescope into and out of passages 40 and 42 formed in the housing assembly.

In use, the case 20 may be placed on the lap of a user and its top opened as shown in FIG. 1. The lateral auxiliary panels 26 and 28 are moved to the user's right and left while the front auxiliary panel 30 and the rear auxiliary panel 32 are extended away from and toward the user, respectively. The housing assembly 24 permits all of the auxiliary panels to be telescoped into overlapping relationship within the housing assembly for compact closure and also for ready expansion to meet the needs of those required to work in crowded conditions or on public transportation or, indeed, anywhere that an adequate writing and support surface is not available.

What is claimed is:

1. A portable writing board accessory for use with a briefcase and elsewhere including a main panel assembly having a pair of internal planar passages extending in planes parallel to the plane of the main panel assembly and in directions normal to each other, and four auxiliary panels telescopically received in said passages, each of said passages receiving a pair of said auxiliary panels for movement in opposite directions.

2. The accessory of claim 1 in which said auxiliary panels are movable between a closed arrangement in which each of said panels is telescoped within a respective one of said passages and wherein said accessory fits readily within a briefcase and an open arrangement in which a portion of each of said panels extends beyond the perimeter of said main panel to form an extended surface.

3. The accessory of claim 1 including means for securing said accessory to a briefcase.

4. The accessory of claim 3 wherein said means for securing said accessory includes a resilient elastic member connected with a briefcase and hooks connected with said accessory for engaging said elastic member.

5. The accessory of claim 4 including clips for removably connecting said resilient member with a briefcase.

6. The accessory of claim 4 wherein said hooks are connected with an edge portion of one of said auxiliary panels.

7. The accessory of claim 1 wherein the auxiliary panels received in one of said passages each includes a pocket formed in an edge portion thereof for receiving papers.

8. The accessory of claim 7 wherein said pockets are formed in opposite edge portions of the respective auxiliary panels.

9. The accessory of claim 1 wherein said main panel assembly includes lip means extending upwardly from one edge thereof for limiting slippage of sheet-like material placed on said main panel assembly.

10. The accessory of claim 1 wherein said main panel assembly includes three planar panel members, and means for securing an outer one of said three planar panel members to each side of the middle one of said planar panel members in parallel spaced relation to define said passages.

11. The accessory of claim 10 wherein each of said planar panel members is generally rectangular and said means for securing includes means for securing the opposite shorter edge portions of an outer one of said planar panel members to said middle planar panel member and the opposite longer edge portions of the other outer one of said planar panel members to said middle panel member.

12. The accessory of claim 11 wherein said means for securing includes spacer means between each of the secured edge portions.

13. The accessory of claim 12 wherein said spacer means includes U-shaped channels.

14. The accessory of claim 11 wherein said means for securing includes spacer means connected between each of said panel members at the corner portions thereof.

15. The accessory of claim 12 wherein said spacer means include two pairs of members disposed between secured edge portions of said planar panel members, the members of each pair being parallel but perpendicular to the members of the other pair.

16. The accessory of claim 1 wherein each pair of said auxiliary panels are overlappingly received in said passages.

17. The accessory of claim 16 wherein one auxiliary panel of each pair includes a folded over edge portion for securing papers or the like to said accessory.

18. A portable writing board accessory for use with a briefcase and elsewhere comprising a main panel assembly having a top, bottom, front, back and opposed lateral sides, four auxiliary panels and means to extend said auxiliary panels from the front, back and opposed lateral sides effectively to enlarge the top of the main panel assembly to provide an enlarged work surface adapted to extend beyond the edge of an open briefcase.

19. A portable writing board accessory for use with a briefcase and elsewhere comprising a main panel assembly, and means to enlarge the panel assembly by extension of at least three contiguous auxiliary panels to provide an enlarged work surface adapted to extend beyond the edge of an open briefcase, said main panel assembly including a front, back and opposed lateral sides, two of said contiguous auxiliary panels being paired and extending from the lateral sides, and another from the front or back.

20. An accessory as set forth in claim 19 including four auxiliary paels, and two separate passages in said main panel assembly, one passage extending from side to side and the other from front to back, each accommodating a pair of said contiguous auxiliary panels.

* * * * *